US006564816B2

(12) United States Patent
Park

(10) Patent No.: US 6,564,816 B2
(45) Date of Patent: May 20, 2003

(54) WATER HAMMER CLEANING MACHINE

(75) Inventor: Kwang-Jin Park, 1007.2dong, Hanyang 3-cha Apt., Bang-yi-dong, Song pa-ku, Seoul (KR)

(73) Assignees: Asia Union Co., Ltd., Whae Jung-Ri (KR); Kwang-Jin Park, Seoul (KR)

( * ) Notice: Subject to any disclaimer, the term of this patent is extended or adjusted under 35 U.S.C. 154(b) by 35 days.

(21) Appl. No.: 09/957,645

(22) Filed: Sep. 20, 2001

(65) Prior Publication Data

US 2003/0051746 A1 Mar. 20, 2003

(51) Int. Cl.[7] ..... B08B 9/032

(52) U.S. Cl. ..... 134/169 C; 137/240

(58) Field of Search ..... 134/169 R, 169 C, 134/102.2; 137/240

(56) References Cited

U.S. PATENT DOCUMENTS

| | | | | | |
|---|---|---|---|---|---|
| 4,869,301 | A | * | 9/1989 | Ohmi et al. | 137/240 X |
| 4,919,154 | A | * | 4/1990 | Engle | 134/169 C X |
| 5,159,956 | A | * | 11/1992 | Kurihara | 134/169 C X |
| 5,265,629 | A | * | 11/1993 | Sajewski | 134/169 C X |
| 5,660,201 | A | * | 8/1997 | Turner | 134/169 C X |
| 5,674,323 | A | * | 10/1997 | Garcia | 134/169 C X |

* cited by examiner

*Primary Examiner*—Philip R. Coe
(74) *Attorney, Agent, or Firm*—Ladas & Parry

(57) ABSTRACT

A water hammer cleaning machine has a cleaning liquid supply piping line with a pump to press cleaning liquid therethrough and an air piping line with compressor to press air therethrough to a piping line to be cleaned. An automatic opening-closing valve on the air piping line opens or closes the air piping line to clean alien substances inside of the piping line with the cleaning liquid and with a shock wave of resulting oscillation.

6 Claims, 1 Drawing Sheet

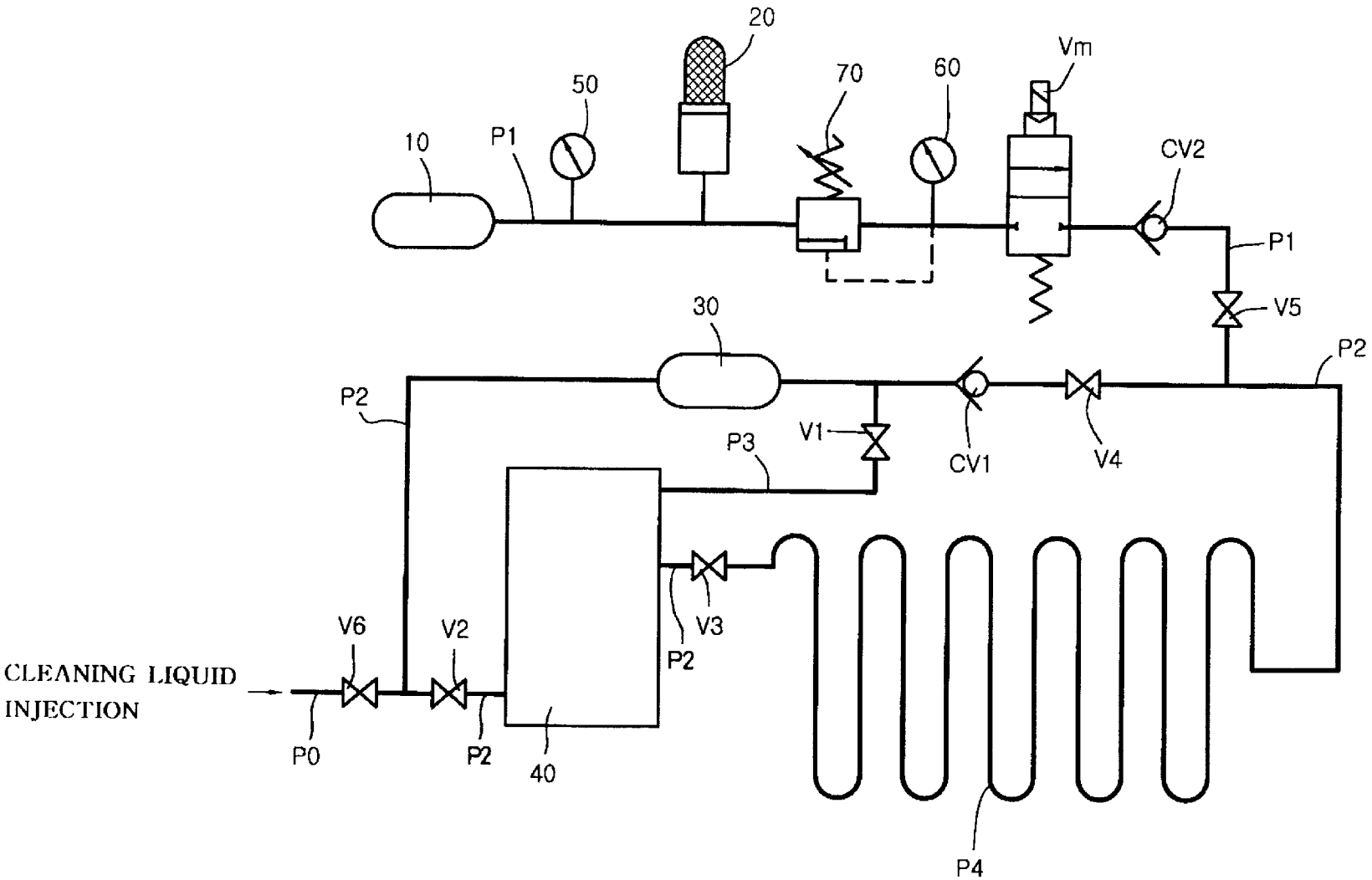
P2
P1
V5
CV2
Vm
V4
60
CV1
70
V1
20
P3
30
V3
P2
50
40
P1
P2
V2
10
P2
V6
P0
CLEANING LIQUID
INJECTION
P4

WATER HAMMER CLEANING MACHINE

BACKGROUND OF THE INVENTION

1. Field of the Invention

The present invention relates to a water hammer cleaning machine removing alien substances adhering, precipitating and remaining on the inner part of a piping line, and more particularly, to a water hammer cleaning machine removing alien substances remaining in a delicate piping line of semi-conductor manufacturing line, e.g. in a delicate piping line cooling a wafer cleaning device or a cleaning device of semi-conductor manufacturing line, and in particular, a water hammer cleaning machine cleaning an inner part of the piping line by water hammer phenomenon of cleaning liquid through intermixing air intermittently compressed by the water hammer cleaning machine with chemical cleaning liquid, accordingly, enhancing whole semi-conductor product yield.

2. Discussion of Related Art

Generally, a piping line is a passage, through which liquid flows, and it can be categorized as air-piping line, a water-piping line, oil-piping line or chemicals-piping line according to liquid. As this piping line is designed to be connected to the devices, it is necessary that alien substances are generated in the inside of the piping line according to the material of the piping line itself, liquid or the use of the devices.

These alien substances remaining in the inside of the piping line cause the deterioration in efficiency of the device system, and in particular, they may cause serious deterioration in yield of semi-conductor manufacturing line. In case that alien substances are generated in a part of piping line of device installed in semi-conductor manufacturing line, the device may be polluted or stop operating at the worst. It brings a heavy economical loss. In addition, it takes long time to remove such alien substances and put normally into operation again.

In order to overcome such drawbacks, it is suggested that cleaning liquid is flown into the inside of piping line so as to clean piping line with the natural cleaning force or that an artificial implement is put into the inside of piping line so as to remove the alien substances. However, such conventional technique requires too much time in order to clean piping line or it may damage the inside of piping line due to mechanical friction so as to cause more serious problems than remaining of the alien substances.

SUMMARY OF THE INVENTION

Therefore, in order to overcome such drawbacks of the prior art, an objective of the present invention is to provide a water hammer cleaning machine, which don't give damage to the inside of piping line as well as can clean the alien substances in the inside of piping line.

Another objective of the present invention is to provide a water hammer cleaning machine capable of reducing cleaning-time in cleaning the alien substances in the inside of piping line.

Another objective of the present invention is to provide a water hammer cleaning machine capable of reducing cleaning-time in cleaning the alien substances in the inside of piping line without damaging the inside of piping line by using water hammer.

To accomplish the objective of the present invention, there is provided a water hammer cleaning machine, which is composed of a closed-circuit in which cleaning liquid circulate between a cleaning liquid tank (40) and a cleanable piping line (P4) which has to be cleaned, comprising: a supply piping line (P2) in which a pump (30) is provided to compress said cleaning liquid; an air piping line (P1), on one portion of which an air compressor (10) is installed and another portion of which connect with cleaning liquid supply piping line (P2) connecting to said cleaning liquid tank (40) and the cleanable piping line (P4) which has to be cleaned; automatic valve (Vm) which is automatically selectively operated between first position, located on the piping line (P1), closing said air piping line (P1) and second position opening it; a water hammer device (20) provided between said air compressor (10) and said automatic opening-closing valve (Vm), and intermitting the compressed air, which is spurted from said air compressor (10) according to the pre-set value in case that said automatic opening-closing valve (Vm) is regulated to the second position, to flow periodically or non-periodically into said air piping line (P1); and control-means provided to regulate said automatic opening-closing valve (Vm), said water hammer device (20) and the rest valves selectively according to pre-set work-process.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a distribution diagram of a water hammer cleaning machine according to the present invention.

DETAILED DESCRIPTION OF PREFERRED EMBODIMENT

Reference will now be made in detail to the preferred embodiments of the present invention, examples of which are illustrated in the accompanying drawings.

FIG. 1 is a distribution diagram of a water hammer cleaning machine according to the present invention.

As illustrated in FIG. 1, the water hammer cleaning machine is constituted to connect to cleaning liquid supply piping line (P2) by installing a water hammer device (20) intermitting at every pre-set time air piping line (P1) provided with air compressor (10) in order to remove in a short time adhering, precipitating or drifting remaining alien substances (hereinafter referred as alien substances) without any damage of the inside of piping line by using water hammer phenomenon.

Here, alien substances capable of remaining inside of piping line include steel bacteria slime, rust, organic matter and inorganic matter.

A cleaning liquid supply piping line (P2), which cleans cleanable piping line (P4) by circulating cleaning liquid, is provided with a pump (30) to compress said cleaning liquid. Cleaning liquid stored in cleaning liquid tank (40) is compressed by said pump (30) and so circulated to remove alien substances remaining inside of cleanable piping line (P4). Here, in order to store cleaning liquid from the outside in cleaning liquid tank (40), there is provided with a branch pipe (P3) connecting the pump (30) to cleaning liquid tank (40), and said branch pipe (P3) is provided with the first valve (V1) which intermits inflow of said cleaning liquid from the outside.

Cleaning liquid supply piping line (P2) connected in both ends of said cleaning liquid tank (40) is provided with the second valve (V2) and the third valve (V3), and these valves (V2) (V3) are opened or closed automatically according to the cleaning process for cleanable piping line (P4) or handled by hand. In addition, the cleaning liquid supply piping line (P2) between the pump (30) and the cleanable piping line (P4) is provided with the fourth valve (V4), which opens or closes the inflow of cleaning liquid into cleanable piping line (P4), and as described above, opens or closes automatically according to the cleaning process or by hand. Further, as say later, in order to cut off the flowing backward of the cleaning liquid due to the compressed air from the air piping line (P1), the first check valve (CV1) is provided between the pump (30) and the fourth valve (V4).

A cleaning liquid injecting pipe (P0), on which the sixth valve (V6) is installed in order to flow the cleaning liquid from the outside into cleanable piping line (P4) or to store the cleaning liquid in cleaning liquid tank (40), is connected to the cleaning liquid supply piping line (P2). Here, the sixth valve (V6), like above described other valves, is opened or closed automatically by the control means.

To accomplish structurally more desirable cleaning of the piping line by forming a water hammer of cleaning liquid, an other end portion of an air piping line (P1), on one end portion of which an air compressor (10) is installed, connects between the fourth valve (V4) of the cleaning liquid supply piping line (P2) and one end portion of cleanable piping line (P4). Here, a water hammer device (20) for generating really a water hammer to cleaning liquid, is provided between the air compressor (10) and the other end portion of the air piping line (P1), and the first pressure gauge (50) is installed between the air compressor (10) and the water hammer device (20) to show the pressure of air spurted from the air compressor (10). Usually, the desirable pressure of the air spurted from the air compressor (10) is 7–8 kgf/cm$^2$.

A W.H.A piston of the water hammer device (20) reciprocates 1–10 times per second according to the pre-set program of not-illustrated control means. Accordingly, the air spurted from said air compressor (10) is restricted in flowing while passing the water hammer device (20), and finally, this compressed air give the regularly intermitted pressure to the cleaning liquid flowing inside of cleaning liquid supply piping line (P2), and as a result of it, the water hammer is generated to the cleaning liquid.

Further, to keep the pressure of the compressed air flowing into the cleaning liquid supply piping line (P2) under needed pressure, a regulator (70) connected to the second pressure gauge (60) is provided between the water hammer device (20) and the other end portion of the air piping line (P1), and this pressure value is changeable by the control means according to the state of the cleanable piping line (P4). The automatic opening-closing valve (Vm) intermitting automatically the whole air piping line (P1) by the control means is provided between said regulator (70) and the other end portion of the air piping line (P1), and the fifth valve (V5), which is opened-closed automatically or by hand, is installed between said automatic opening-closing valve (Vm) and the other end portion of the air piping line (P1).

Here, said automatic opening-closing valve (Vm), as described above, is automatically manipulated between the first position, which is commonly a basic position for closing the air piping line (P1), and the second position, which open the air piping line (P1) according to a signal of the control means. In addition, to prevent the cleaning liquid from flowing backward into the air piping line (P1), the second checking valve (CV2) is installed between the automatic opening-closing valve (Vm) and the fifth valve (V5).

The operation relation of a water hammer cleaning machine according to the present invention could be generally explained referring to the table 1, and the present structure could be modified and operated variously with out being confined to the below-described operation relation.

TABLE 1

| | Valve/pump | | | | | | | |
|---|---|---|---|---|---|---|---|---|
| Cleaning process | V1 | V2 | V3 | V4 | V5 | V6 | pump | Pump |
| Cleaning liquid intake | On | Off | off | Off | Off | On | Intake<br>Off | Finish<br>off |
| Cleaning liquid recovery | Off | On | On | On | Off | Off | recovery<br>On | Finish<br>Off |
| Cleaning liquid intake, spurt (V6) (V4) | Off | Off | Off | On | Off | On | Intake<br>On | Finish<br>Off |
| Cleaning liquid recovery, spurt (V3) (V4) | off | on | On | on | On | off | | |
| Water hammer spurt (V5) | | | | | | | | |

1. Cleaning Liquid Intake

The cleaning liquid is flown from the cleaning liquid supply means through the cleaning liquid pouring pipe (P0) into the cleaning liquid supply piping line (P2) and then pressured by the pump (30), and stored in the cleaning liquid tank (40) because the fourth valve (VA) is closed.

2. Cleaning Liquid Recovery (or Circulation)

The cleaning liquid, which is in the inside of the cleaning liquid supply piping line (P2) and the cleanable piping line (P4), is recovered back into the cleaning liquid tank (40) by the operation of the pump (30).

3. Cleaning Liquid Intake, Spurt

First, the cleaning liquid is filled up in the inside of the cleaning liquid supply piping line (P2) and the cleanable piping line (P4).

4. Cleaning Liquid Recovery, Spurt

The cleaning liquid is circulated between the closed circuit and then, the cleanable piping line (P4) is cleaned by the cleaning liquid, in which the water hammer is generated.

Here, when the cleaning process is finished, the cleaning liquid could be drained to the outside by opening only the second valve (V2) and the sixth Valve (V6), or by operating the pump (30).

As described above, the present invention can clean the alien substances in the inside of the piping line effectively with the cleaning liquid using the water hammer which is caused by compressed cleaning liquid influenced by the compressed air intermitted by the water hammer device as well as can clean desirably by using the impulse wave or the vibration caused by the water hammer.

Generally, it takes 6–8 hours to clean the semi-conductor device. However, it takes about 30 minutes for the present invention to clean it, and the cleaning process according to the present invention can run easily because the entire cleaning process runs full-automatically.

It will be apparent to those skilled in the art that various modifications and variations can be made in the water hammer cleaning machine of the present invention without departing from the spirit or scope of the invention. Thus, it is intended that the present invention cover the modifications and variations of this invention provided they come within the scope of the appended claims and their equivalents.

What is claimed is:

1. A water hammer cleaning machine comprising:

a cleaning liquid supply piping line (P2) composed of a closed circuit in order for cleaning liquid to be circulated selectively between a cleaning liquid tank (40) and a cleanable piping line (P4) as well as provided with a pump (30) to give pressure to said cleaning liquid, an air piping line (P1), on an end portion of which is installed an air compressor (10) and the other end portion of which is connectd selectively to said cleaning liquid tank (40) and the cleaning liquid supply piping line (P2) connecting with the cleanable piping line (P4), an automatic opening-closing valve (Vm) being provided on said air piping line (P1) and being handled automatically selectively between the first position closing said air piping line (P1) and the second position opening said air piping line (P1), a water hammer device (20) provided between said air compressor (10) and said automatic opening-closing valve (Vm), and intermitting the compressed air, which is spurted from said air compressor (10) according to the pre-set value in case that said automatic opening-closing valve (Vm) is regulated to the second position, to flow periodically or non-periodically into said air piping line (P1), and a control means provided to control said automatic opening-closing valve (Vm), said water hammer device (20) and other valves selectively according to the pre-set work-process.

2. The device as claimed in claim 1, wherein a second checking valve (CV2) is provided between said automatic opening-closing valve (Vm) and the other end portion of said air piping line (P1) in order for said cleaning liquid not to flow backward into said air piping line (P1).

3. The device as claimed in claim 1, wherein a regulator (70) is provided between said water hammer device (20) and said automatic opening-closing valve (Vm) to keep a fixed pressure of the air compressed by said air compressor (10).

4. The device as claimed in claim 1, wherein a first checking valve (CV1) is provided between said pump (30) and the other end portion of said cleaning liquid supply piping line (P2) in order for said cleaning liquid not to flow backward into the pump (30) of said cleaning liquid supply piping line (P2).

5. The device as claimed in claim 1, wherein a branch pipe (P3) is connected between said cleaning liquid tank (40) and an end portion of said pump (30) in order to fill up said cleaning liquid tank (40) with the cleaning liquid supplied from the outside.

6. The device as claimed in claim 1, wherein there is provided a cleaning liquid injecting pipe (P0), an end portion of which is connect to the cleaning liquid supply means from the outside, and the other end portion of which be connect selectively with said cleaning liquid supply piping line (P2) adjacent to the said cleaning liquid tank (40).

* * * * *